US011839264B2

(12) United States Patent
Bell et al.

(10) Patent No.: US 11,839,264 B2
(45) Date of Patent: Dec. 12, 2023

(54) UPPER FOR AN ARTICLE OF FOOTWEAR

(71) Applicant: NIKE, Inc., Beaverton, OR (US)

(72) Inventors: Thomas G. Bell, Portland, OR (US); Tobie D. Hatfield, Lake Oswego, OR (US); Elizabeth A. Kilgore, Portland, OR (US); Andrew A. Owings, Portland, OR (US); Brandon J. Wilen, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 184 days.

(21) Appl. No.: 17/331,548

(22) Filed: May 26, 2021

(65) Prior Publication Data

US 2021/0368945 A1 Dec. 2, 2021

Related U.S. Application Data

(60) Provisional application No. 63/032,668, filed on May 31, 2020.

(51) Int. Cl.
*A43C 1/06* (2006.01)
*A43C 11/16* (2006.01)

(52) U.S. Cl.
CPC ..... *A43C 1/06* (2013.01); *A43C 11/16* (2013.01)

(58) Field of Classification Search
CPC ..... A43C 1/06; A43C 11/16; A43C 11/008; A43C 11/1493; A43C 1/00; A43C 1/003
See application file for complete search history.

(56) References Cited

U.S. PATENT DOCUMENTS 5,117,567 A * 6/1992 Berger ..... A43C 11/165 36/50.1
5,463,822 A * 11/1995 Miller ..... A43C 11/165 36/50.1

(Continued)

FOREIGN PATENT DOCUMENTS

WO WO-2017066415 A1 4/2017

OTHER PUBLICATIONS

European Patent Office, PCT International Search Report and Written Opinion dated Sep. 10, 2021 for application No. PCT/US2021/034361.

*Primary Examiner* — Robert Sandy
*Assistant Examiner* — Rowland Do
(74) *Attorney, Agent, or Firm* — Honigman LLP; Matthew H. Szalach; Jonathan P. O'Brien

(57) ABSTRACT

An article of footwear includes an upper having an enclosure including an adjustment region extending from a first edge to a second edge formed on an opposite side of the adjustment region from the first edge. The upper further includes a cable tensioning guide attached to the enclosure adjacent to the first edge of the adjustment region. The cable tensioning guide includes a first conduit and a second conduit. A cable of the upper includes a tensioning element having a first tensioning segment extending across the adjustment region from the first conduit and a second tensioning segment extending across the adjustment region from the second conduit. The cable further includes a control element having a first control segment connected to the first tensioning segment at the first conduit, and a second control segment connected to the second tensioning segment at the second conduit.

20 Claims, 7 Drawing Sheets

(56) References Cited

U.S. PATENT DOCUMENTS

| | | | | |
|---|---|---|---|---|
| 5,469,640 | A * | 11/1995 | Nichols | A43C 1/00 24/712.1 |
| 2003/0051374 | A1* | 3/2003 | Freed | A43C 11/008 36/50.1 |
| 2004/0078999 | A1* | 4/2004 | Freed | A43C 11/008 36/50.1 |
| 2004/0226190 | A1 | 11/2004 | Elkington et al. | |
| 2006/0070261 | A1* | 4/2006 | Reagan | A43C 11/008 36/115 |
| 2017/0105489 | A1* | 4/2017 | Lovett | A43C 11/20 |
| 2018/0110294 | A1* | 4/2018 | Schneider | A43B 3/38 |
| 2018/0110298 | A1 | 4/2018 | Schneider et al. | |
| 2018/0199673 | A1* | 7/2018 | Schneider | A43C 7/06 |
| 2019/0021447 | A1 | 1/2019 | Whewell et al. | |
| 2019/0365017 | A1* | 12/2019 | Sandy | A41F 1/002 |
| 2020/0138145 | A1* | 5/2020 | Greenspan | A43C 1/003 |
| 2020/0205524 | A1* | 7/2020 | Hatfield | A43C 1/06 |
| 2021/0093046 | A1* | 4/2021 | Lam | A43C 1/003 |
| 2021/0153605 | A1* | 5/2021 | Hopkins | A43C 11/008 |
| 2022/0225736 | A1* | 7/2022 | Kagami | A43C 11/1493 |
| 2022/0279898 | A1* | 9/2022 | Singh | D04B 1/123 |

* cited by examiner

UPPER FOR AN ARTICLE OF FOOTWEAR

CROSS REFERENCE TO RELATED APPLICATIONS

This application claims priority under 35 U.S.C. § 119(e) to U.S. Provisional Application No. 63/032,668, filed on May 31, 2020. The disclosure of this prior application is considered part of the disclosure of this application and is hereby incorporated by reference in its entirety.

FIELD

The present disclosure relates generally to an article of footwear.

BACKGROUND

This section provides background information related to the present disclosure which is not necessarily prior art.

Articles of footwear conventionally include an upper and a sole structure. The upper may be formed from any suitable material(s) to receive, secure and support a foot on the sole structure. A bottom portion of the upper, proximate to a bottom surface of the foot, attaches to the sole structure. Sole structures generally include a layered arrangement extending between an outsole providing abrasion-resistance and traction with a ground surface and a midsole disposed between the outsole and the upper for providing cushioning for the foot.

The upper may cooperate with laces, straps, or other fasteners to adjust the fit of the upper around the foot. For instance, laces may be tightened to close the upper around the foot and tied once a desired fit of the upper around the foot is attained. Care is required to ensure that the upper is not too loose or too tight around the foot each time the laces are tied. Moreover, the laces may loosen or become untied during wear of the footwear.

Known automated tightening systems typically include a tightening mechanism, such as a rotatable knob, that can be manipulated to apply tension to one or more cables that interact with the upper for closing the upper around a foot. While these automated tightening systems can incrementally increase the magnitude of tension of the one or more cables to achieve a desired fit of the upper around a foot, they require a time-consuming task of manipulating the tightening mechanism to properly tension the cables for securing the upper around the foot. Further, when it is desired to remove the footwear from the foot, the wearer is required to simultaneously depress a release mechanism and pull the upper away from the foot to release the tension of the cables.

Thus, known automated tightening systems lack suitable provisions for both quickly and variably adjusting the tension of cables to close an upper around a foot and do not allow a wearer to quickly release the tension applied to the cables so that the upper can be quickly loosened for removing the footwear from the foot. Moreover, the tightening mechanism employed by these known automated tightening systems requires a complex locking mechanism to be incorporated into the article of footwear to secure the cable in a tensioned state.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
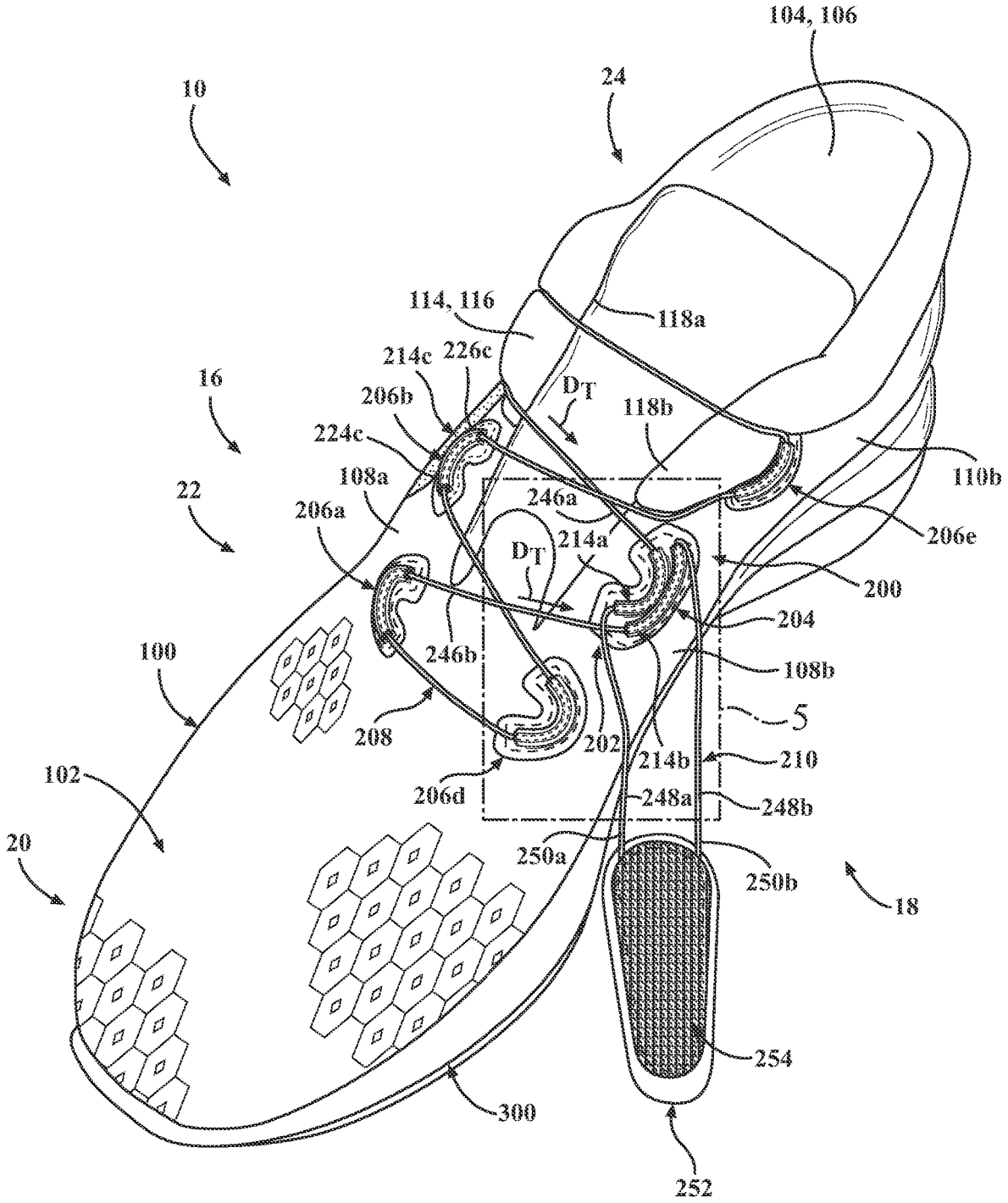
FIG. 1 is a top-medial perspective view of an article of footwear in accordance with principles of the present disclosure and shown in a relaxed state.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

The details of one or more implementations of the disclosure are set forth in the accompanying drawings and the description below. Other aspects, features, and advantages will be apparent from the description, the drawings, and the claims.

Referring to FIGS. 1-7, an example of an article of footwear 10 including a system providing for variable tension is disclosed. In some implementations, the article of footwear 10 includes an upper 100 and a tensioning system 200 integrated into the upper 100. The tensioning system 200 includes a cable 202 routed along the upper 100 and configured to manage the tension of the upper 100. The upper 100 and the tensioning system 200 cooperate to move the article of footwear 10 between a relaxed state and a tightened state. Particularly, the cable 202 is movable in a tightening direction $D_T$ to move the article of footwear 10 into the tightened state, and in a loosening direction $D_L$ to move the article of footwear 10 into the loosened state. The article of footwear 10 further includes a sole structure 300 attached to the upper 100 and configured to provide cushioning and traction properties to the footwear 10.

Figure 2:
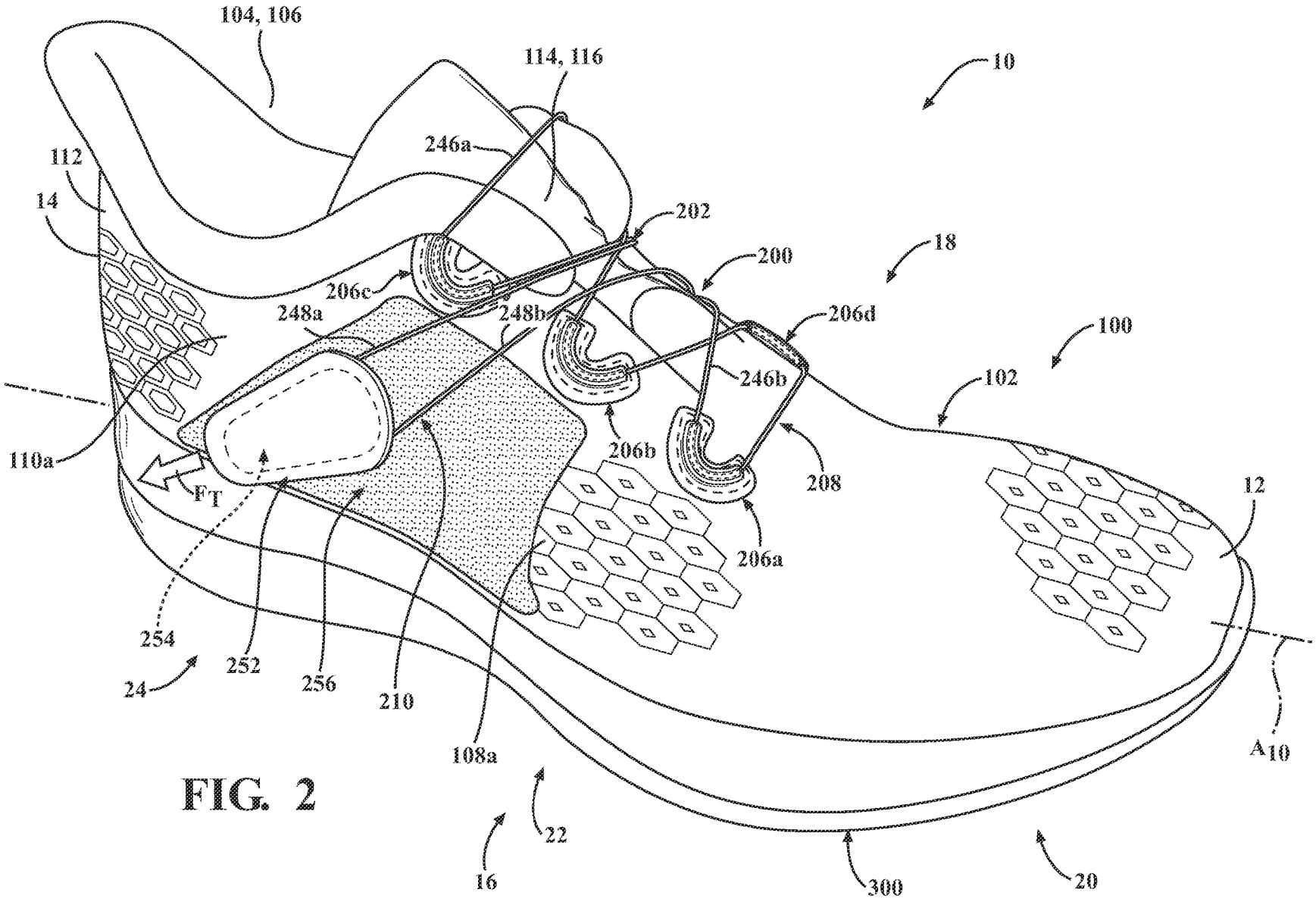
FIG. 2 is a top-lateral perspective view of the article of footwear of FIG. 1 shown in a tightened state.
Figure 3:
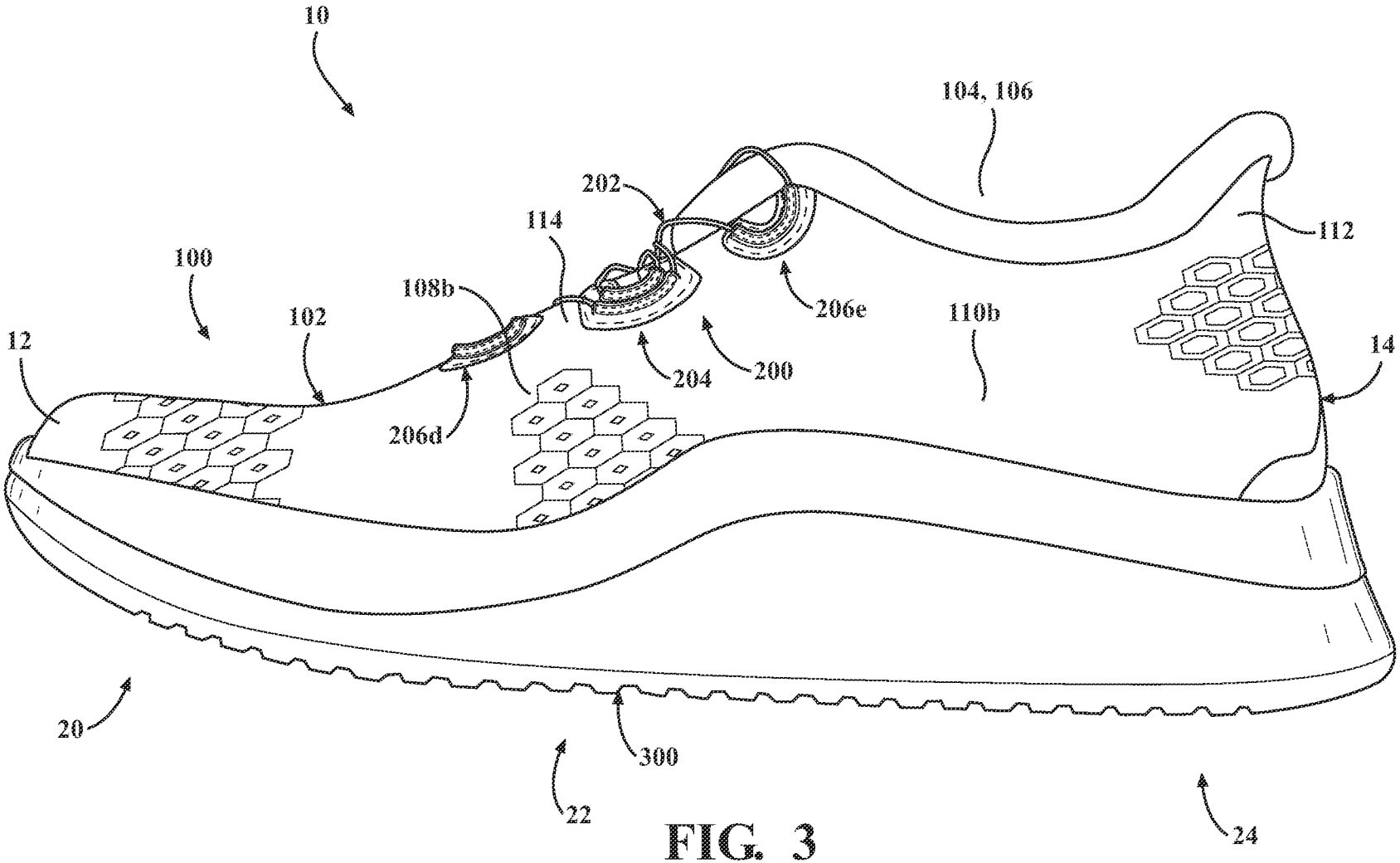
FIG. 3 is a medial side elevation view of the article of footwear of FIG. 1.

The article of footwear 10, and components thereof, may be described as including an anterior end 12 associated with a forward-most point of the footwear 10, and a posterior end 14 corresponding to a rearward-most point of the footwear 10. As shown in FIG. 2, a longitudinal axis $A_{10}$ of the footwear 10 extends along a length of the footwear 10 from the anterior end 12 to the posterior end 14, and generally divides the footwear 10 into a lateral side 16 and a medial side 18. Accordingly, the lateral side 16 and the medial side 18 respectively correspond with opposite sides of the footwear 10 and extend from the anterior end 12 to the posterior end 14.

The article of footwear 10 may be divided into one or more regions along the longitudinal axis $A_{10}$. The regions may include a forefoot region 20, a mid-foot region 22, and a heel region 24. The forefoot region 20 may correspond with toes and joints connecting metatarsal bones with phalanx bones of a foot. The mid-foot region 22 may correspond with an arch area of the foot, and the heel region 24 may correspond with rear regions of the foot, including a calcaneus bone.

The upper 100 includes an enclosure 102 having a plurality of components that cooperate to define an interior void 104 and an ankle opening 106, which cooperate to receive and secure a foot for support on the sole structure 300. For example, the upper 100 includes a pair of quarter panels 108*a*, 108*b* extending upwardly from the sole structure 300 in the mid-foot region 22 on opposite sides of the interior void 104. The upper 100 of the article of footwear 10 may be further described as including heel side panels 110*a*, 110*b* extending through the heel region 24 along the lateral and medial sides 16, 18 of the ankle opening 106. A heel counter 112 wraps around the posterior end 14 of the footwear 10 and connects the heel side panels 110*a*, 110*b*. A throat 114 extends across the top of the upper 100 and defines an instep region extending between the quarter panels 108*a*, 108*b* from the ankle opening 106 to the forefoot region 20. In the illustrated example, the throat 114 is enclosed with a material panel extending between the opposing quarter panels 108*a*, 108*b* in the instep region to cover the interior void 104.

The components of the enclosure 102 may be formed from one or more materials that are stitched or adhesively bonded together to define the interior void 104. Suitable materials of the upper 100 may include, but are not limited to, textiles, foam, leather, and synthetic leather. The example upper 100 may be formed from a combination of one or more substantially inelastic or non-stretchable materials and one or more substantially elastic or stretchable materials disposed in different regions of the upper 100 to facilitate movement of the article of footwear 10 between the tightened state and the loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

The enclosure 102 of the upper 100 includes one or more adjustment regions 116 configured to allow the enclosure 102 to expand and contract around a foot. In the illustrated example, the upper 100 includes a single adjustment region 116 formed by the throat 114 of the enclosure 102. The adjustment region 116 extends from a first edge 118*a* extending along an upper end of the lateral quarter panel 108*a* to a second edge 118*b* extending along an upper end of the medial quarter panel 108*a*. As shown, the adjustment region 116 includes an elastic material extending between the first edge 118*a* and the second edge 118*b* such that the adjustment region 116 is enclosed. However, in other examples, the edges 118*a*, 118*b* of the adjustment region 116 may be detached from one another and/or an independent panel (e.g., a tongue) may be disposed between the edges 118*a*, 118*b*.

While the illustrated example of the article of footwear 10 shows the adjustment region 116 formed along the throat 116 of the enclosure 102, the principles of the present disclosure may be applied to articles of footwear having adjustment regions in other areas of the upper. For instance, an article of footwear may have a first adjustment region formed along one of the lateral side 16 of the enclosure 102 or the medial side 18 of the enclosure. Additionally or alternatively, the enclosure 102 may include a plurality of adjustment regions each configured to provide a degree of adjustment to the upper 100.

With reference to FIG. 1, the tensioning system 200 includes the cable 202 and one or more cable guides 204, 206*a*-206*e* configured to route the cable 202 along the adjustment region 116. The cable 202 may be described as including a tensioning element 208 routed along the adjustment region 116 and a control element 210 connected to the tensioning element 208 to move the article of footwear 10 between the tightened state and the relaxed state. The cable guides 204, 206*a*-206*e* include a tensioning guide 204 configured to transfer a tensioning force from the control element 210 to the tensioning element 208, and one or more optional routing guides 206*a*-206*e* for slidingly routing the tensioning element 208 along the adjustment region 116.

The cable 202 is movable in a tightening direction $D_T$ to move the article of footwear 10 into the tightened state, and in a loosening direction $D_L$ to allow the article of footwear 10 to transition to a relaxed state. The cable 202 may be highly lubricous and/or may be formed from one or more fibers having a low modulus of elasticity and a high tensile strength. For instance, the fibers may include high modulus polyethylene fibers having a high strength-to-weight ratio and a low elasticity. Additionally or alternatively, the cable 202 may be formed from a molded monofilament polymer and/or a woven steel with or without other lubrication coating. In some examples, the cable 202 includes multiple strands of material woven together.

Figure 5:
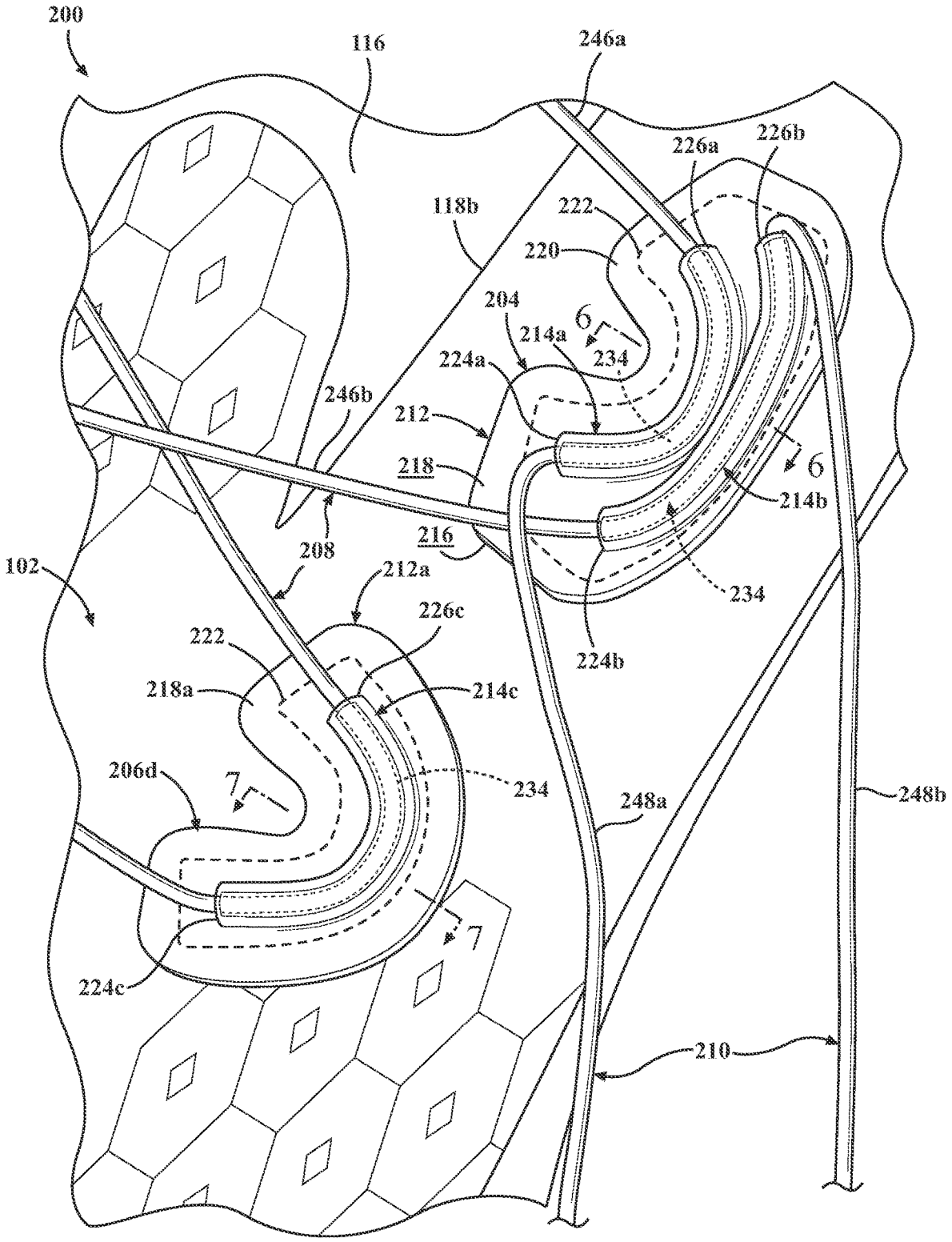
FIG. 5 is an enlarged fragmentary view of the article of footwear of FIG. 1, taken at area 5 of FIG. 1.

Referring to FIGS. 1 and 5, the tensioning system 200 includes one of the tensioning guides 204 disposed adjacent to one of the lateral edge 118*a* or the medial edge 118*b*. In the illustrated example, the tensioning guide 204 is disposed along an intermediate portion of the medial edge 118*b* of the adjustment region 116. The tensioning guide 204 includes a base 212 and a pair of routing elements 214*a*, 214*b* attached to the base 212. As described in greater detail below, each of the routing elements 214*a*, 214*b* is configured to slidingly receive a strand of the cable 202 therein, to facilitate tracked movement of the cable 202 along the adjustment region 116.

Figure 6:
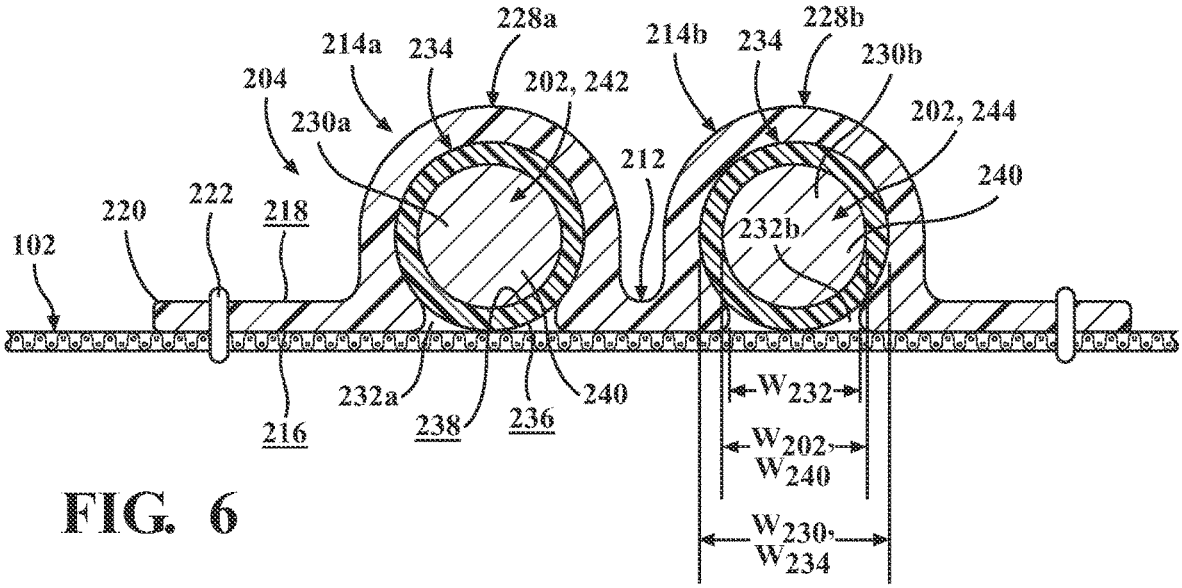
FIG. 6 is a cross-sectional view of an example of a cable guide for the article of footwear of FIG. 1, taken at Line 6-6 of FIG. 5.

As best shown in FIGS. 5 and 6, the base 212 of the tensioning guide 204 includes a substantially planar inner surface 216 and a substantially planar outer surface 218 formed on an opposite side of the base 212 from the inner surface 216. The base 212 includes a flange portion 220 defining an outer periphery of the tensioning guide 204 and, as shown in FIG. 6, is configured to be attached to the enclosure 102 of the upper 100 to secure a position of the tensioning guide 204 relative to the adjustment region 116. In the illustrated example, the flange portion 220 is attached to an exterior surface of the enclosure 102 by stitching 222. However, in other examples, the flange portion 220 may be attached to the enclosure 102 using other means, such as melding, adhesives, or mechanical fasteners. Furthermore, the flange portion 220 may be integrated between material layers of the enclosure 102, or may be attached to an interior surface of the enclosure 102.

With continued reference to FIG. 5, the routing elements 214*a*, 214*b* of the tensioning guide 204 are arranged in parallel with each other and, in some configurations, are concentric with one another. In other words, each of the routing elements 214*a*, 214*b* slidingly receives a respective portion of the cable 202 such that a portion of the cable 202 received within the first routing element 214*a* can be translated or moved independently of the portion of the cable 202 received within the second routing element 214*b*. In the illustrated example, each of the routing elements 214*a*, 214*b* extends from a first end 224*a*, 224*b* to a second end 226*a*, 226*b* along an arcuate path. As shown, the tensioning guide 204 is arranged on the enclosure 102 such that the ends 224*a*, 224*b*, 226*a*, 226*b* of the routing elements 214*a*, 214*b* are oriented towards (i.e., face) the adjustment region 116. Accordingly, the portions of the cable 202 received in the routing elements 214*a*, 214*b* are guided to and from the adjustment region 116 by the curved ends 224*a*, 224*b*, 226*a*, 226*b* of the routing elements 214*a*, 214*b*. While the illustrated routing elements 214*a*, 214*b* are shown in a side-by-side arrangement, in other examples, the routing elements 214*a*, 214*b* may be stacked and extend around a common axis. Additionally or alternatively, the routing elements 214*a*, 214*b* may be embodied as rotatable members, such as pulleys.

Referring to FIG. 6, the construction of the tensioning guide 204 is illustrated. As previously introduced, the tensioning guide 204 includes the base 212 and the pair of routing elements 214*a*, 214*b* attached to the base 212. As shown, the base 212 and the routing elements 214*a*, 214*b* may be integrally formed of a single piece of material. For example, the base 212 and the routing elements 214*a*, 214*b* may be integrally molded of a flexible polymeric material.

Each of the routing elements 214*a*, 214*b* is formed by a tubular outer wall 228*a*, 228*b* extending continuously from the first end 224*a*, 224*b* to the second end 226*a*, 226*b* along the arcuate path. Accordingly, the outer wall 228*a*, 228*b* defines an elongate channel 230*a*, 230*b* extending through the routing element 214*a*, 214*b* continuously from the first end 224*a*, 224*b* to the second end 226*a*, 226*b*. A cross-section of the channel 230*a*, 230*b* has a width $W_{230}$ defined by one or more interior surfaces of the outer wall 228*a*, 228*b*. In the illustrated example, the outer wall 228*a*, 228*b* of each routing element 214*a*, 214*b* has an arcuate cross-sectional shape and defines a cylindrical channel 230*a*, 230*b* having a width $W_{230}$ defined by an inside diameter of the outer wall 228*a*, 228*b*.

Each of the routing elements 214*a*, 214*b* also includes a slot 232*a*, 232*b* formed through the base 212 and into the channel 230*a*, 230*b*. The slot 232*a*, 232*b* extends along the entire length of the channel 230*a*, 230*b* to provide access to the channel 230*a*, 230*b* through the base 212. Thus, when the tensioning guide 204 is secured to the enclosure 102, the slots 232*a*, 232*b* of the routing elements 214*a*, 214*b* may be covered or concealed by the material of the enclosure 102 such that the channels 230*a*, 230*b* cooperate with the material of the enclosure 102 to surround the cable 202. With continued reference to FIG. 6, each of the slots 232*a*, 232*b* has a width $W_{232}$ that is less than the width $W_{230}$ of the corresponding channel 230*a*, 230*b*.

With continued reference to FIG. 6, the tensioning guide 204 includes a pair of bearing sleeves 234 each disposed within a respective one of the routing elements 214*a*, 214*b*. As shown, the bearing sleeves 234 include an outer surface 236 that faces the outer wall 228*a*, 228*b* and an inner surface 238 that defines a conduit or passage 240 through the bearing sleeve 234. The outer surface 236 defines an overall width $W_{234}$ of the bearing sleeve 234, while the inner surface 238 defines a width $W_{240}$ of the conduit 240. Here, the bearing sleeve 234 has a circular cross-section and extends continuously from the first end 224*a*, 224*b* to the second end 226*a*, 226*b* of each routing element 214*a*, 214*b*. The cable 202 is slidingly received within the conduit 240 of each of the bearing sleeves 234 and has a width $W_{202}$ that is less than or equal to the width of the conduit 240. The bearing sleeves 234 include a material having a lower coefficient of friction than the material of the outer walls 228*a*, 228*b* and provide a lubricous interface between the cable 202 and the tensioning guide 204. For instance, the inner surface 238 of the bearing sleeves 234 may include a lubricous coating, such as polytetrafluoroethylene (i.e., Teflon). Additionally, the bearing sleeves 234 may include a material having a greater hardness than the materials of the cable guides 204, 206*a*-206*e*.

As shown in FIG. 6, the width $W_{234}$ of each bearing sleeve 234 is less than the widths $W_{230}$ of the channels 230*a*, 230*b* and greater than the widths $W_{232}$ of the slots 232. Accordingly, the bearing sleeves 234 are constrained within the channels 230 by the outer wall 228*a*, 228*b*. During assembly of the tensioning guide 204, the bearing sleeves 234 are "snapped" into the channels 230*a*, 230*b* of the routing elements 214*a*, 214*b* by pressing the bearing sleeves 234 through the slots 232*a*, 232*b* of the channels 230*a*, 230*b*. The outer surface 236 of the bearing sleeve 234 causes the edges of the outer wall 228*a*, 228*b* that define the slot 232*a*, 232*b* to be biased apart from each other to temporarily increase the width $W_{232}$ of the slot 232*a*, 232*b*, thereby allowing the bearing sleeve 234 to pass into the channel 230*a*, 230*b*. Once the bearing sleeve 234 is fully seated within the channel 230*a*, 230*b* (i.e., the outer surface 236 is positioned against the outer wall 228*a*, 228*b*), the resilient material of the outer wall 228*a*, 228*b* causes the slot 232*a*, 232*b* to return to the nominal width $W_{230}$ to retain the bearing sleeve 234 within the channel 230*a*, 230*b*.

Figure 8:
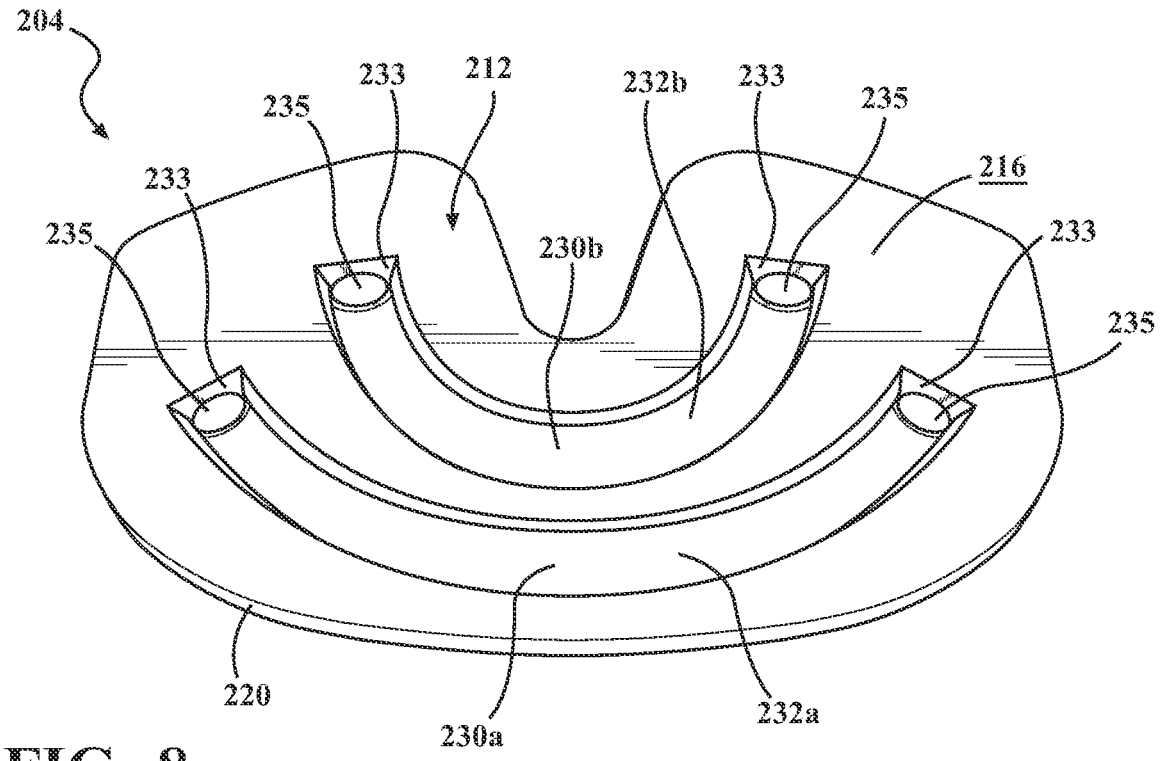
FIG. 8 is a bottom perspective view of a cable tensioning guide in accordance with the principles of the present disclosure.

Optionally, the routing elements 214*a*, 214*b* may include one or more retainers 233 configured to prevent longitudinal movement of the bearing sleeve 234 within the channel 230*a*-230*b* during use. As shown in FIG. 8, each of the routing elements 214*a*, 214*b* includes a retainer 233 embodied as a cap 233 disposed at each end 224*a*, 224*b*, 226*a*, 226*b* of the routing element 214*a*, 214*b*. The cap 233 includes an aperture 235 that is smaller in size than the bearing sleeve 234, thereby obstructing the bearing sleeve 234 at each end 224*a*, 224*b*, 226*a*, 226*b*. In the illustrated example, the aperture 235 is oval-shaped and has a minor diameter that is less than the width $W_{234}$ of the bearing 234 and a major diameter that is greater than the width $W_{234}$ of the bearing 234. Thus, the minor diameter of the aperture 235 obstructs the bearing sleeve 234 while the major diameter allows for easier routing and passage of the cable 202 through the routing element.

With continued reference to FIGS. 1 and 5, the tensioning system 200 may optionally include a plurality of routing guides 206*a*-206*e* arranged along either or both edges 118*a*, 118*b* of the adjustment region 116. In the illustrated example, the tensioning system 200 is shown as including a plurality routing guides 206*a*-206*c* arranged in series along a length of the lateral edge 118*a* and a pair of the routing guides 206*d*, 206*e* arranged at opposite ends of the medial edge 118*b*. Thus, the routing guides 206*d*, 206*e* on the medial edge 118*b* are disposed on opposite sides of the tensioning guide 204.

Figure 7:
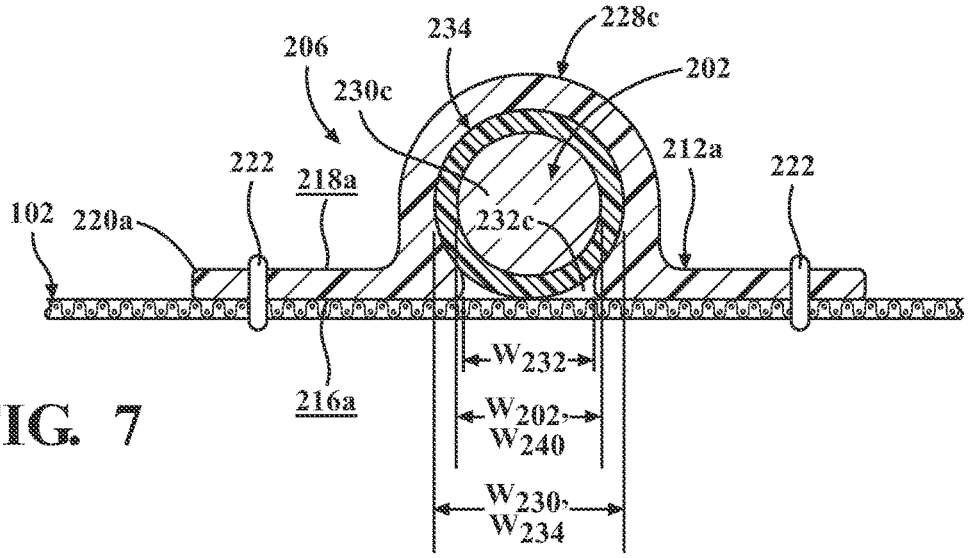
FIG. 7 is a cross-sectional view of an example of a cable guide for the article of footwear of FIG. 1, taken at Line 7-7 of FIG. 5.
Figure 9:
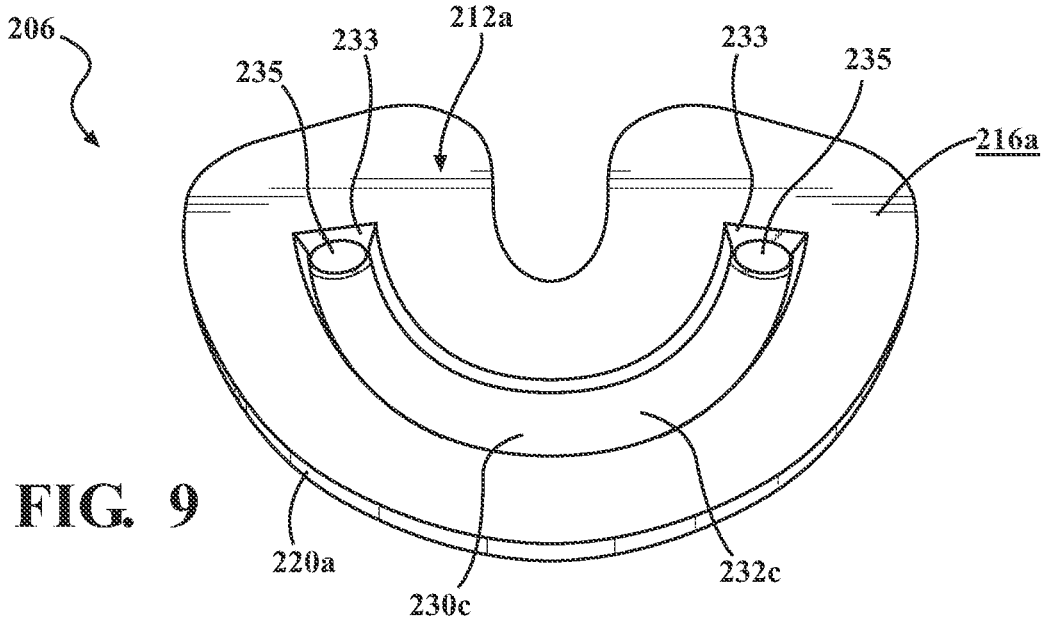
FIG. 9 is a bottom perspective view of a cable routing guide in accordance with the principles of the present disclosure.

The routing guides 206 are configured substantially similarly to the tensioning guide 204 discussed previously, but only include a single routing element 214*c* attached to an outer surface 216*a* of a base 212*a*. The base includes an inner surface 216*a* facing the enclosure 102 and the outer surface 218*a* formed on an opposite side from the inner surface 216*a*. The base 212 also includes an outer flange 220*a* attached to the enclosure 102 by the stitching 222. As shown in FIG. 7, the routing element 214*c* includes an outer wall 228*c* defining a channel 230*c* and a slot 232*c*, where one of the bearing sleeves 234 is received within the channel 230*c* through the slot 323*c*. FIG. 9 shows that the routing element 214*c* includes the retainers 233 at each end 224*c*, 226*c*.

Turning now to FIGS. 1 and 2, the routing of the cable 202 is described and shown. For the sake of clarity, the cable 202 may be described as including a first strand 242 routed through the first routing element 214*a* of the tensioning guide 204, and a second strand 244 routed through the second routing element 214*b* of the tensioning guide 204. Additionally, the cable 202 may be described as including first and second tensioning segments 246*a*, 246*b* cooperating to form the tensioning element 208 of the cable 202, and first and second control segments 248*a*, 248*b* cooperating to form the control element of the cable 202. Here, the first strand 242 of the cable 202 includes the first tensioning segment 246*a* and the first control segment 248*a*, which are connected to each other through the first routing element 214*a*. The second strand 244 of the cable 202 includes the second tensioning segment 246*b* and the second control segment 248*b*, which are connected to each other through the second routing element 214*b*.

Referring still to FIGS. 1 and 2, the first tensioning segment 246*a* extends across the adjustment region 116 from the second end 226*a* of the first routing element 214*a* to a first one of the routing guides 206*c* disposed at a posterior end of the lateral edge 118*a* of the adjustment region 116. The first tensioning segment 246*a* is routed through the conduit 240 of the first routing guide 206*c* and extends back across the posterior end of the adjustment region 116 to a second one of the routing guides 206*e* disposed at a posterior end of the medial edge 118*b*. The first tensioning segment 246*a* passes through the conduit 240 of the routing guide 206*e* and returns back across the adjustment region to a second end 226*c* of a third routing guide 206*b* disposed in an intermediate portion of the lateral edge 118*a*. The second tensioning segment 246*b* is connected to the first tensioning segment 246*a* at the third routing guide 206*b*, and extends across the adjustment region 116 from the first end 224*c* of the third routing guide 206*b* to a fourth routing guide 206*d* disposed at an anterior end of the medial edge 118*b*. The second tensioning segment 246*b* passes through the conduit 240 of the fourth routing guide 206*d* and extends across the anterior end of the adjustment region to a fifth routing guide 206*a* disposed at an anterior end of the lateral edge 118*a*. From the fifth routing guide 206*a*, the second tensioning segment 246*b* returns to the first end 224*b* of the second routing element 214*b*.

As just described, the tensioning element 208 is routed across the adjustment region 116 from the second end 226*a* of the first routing element 214*a* to the first end 224*b* of the second routing element 214*b* through the plurality of the routing guides 206*a*-206*e*. The cable 202 is slidingly received within the conduits 240 of each of the routing guides 206*a*-206*e*. Thus, when the effective lengths of the first and second tensioning segments 246*a*, 246*b* are reduced by moving the cable 202 in the tightening direction $D_T$ (i.e., pulling the control element 210), the cable 202 will slide through the conduits 240 of the routing guides 206 to draw the routing guides 206*a*-206*c* on the lateral edge 118*a* towards the routing guides 206*d*, 206*e* and tensioning guide 204 on the medial edge 118*b*, thereby constricting the adjustment region 116 over the foot.

Figure 4:
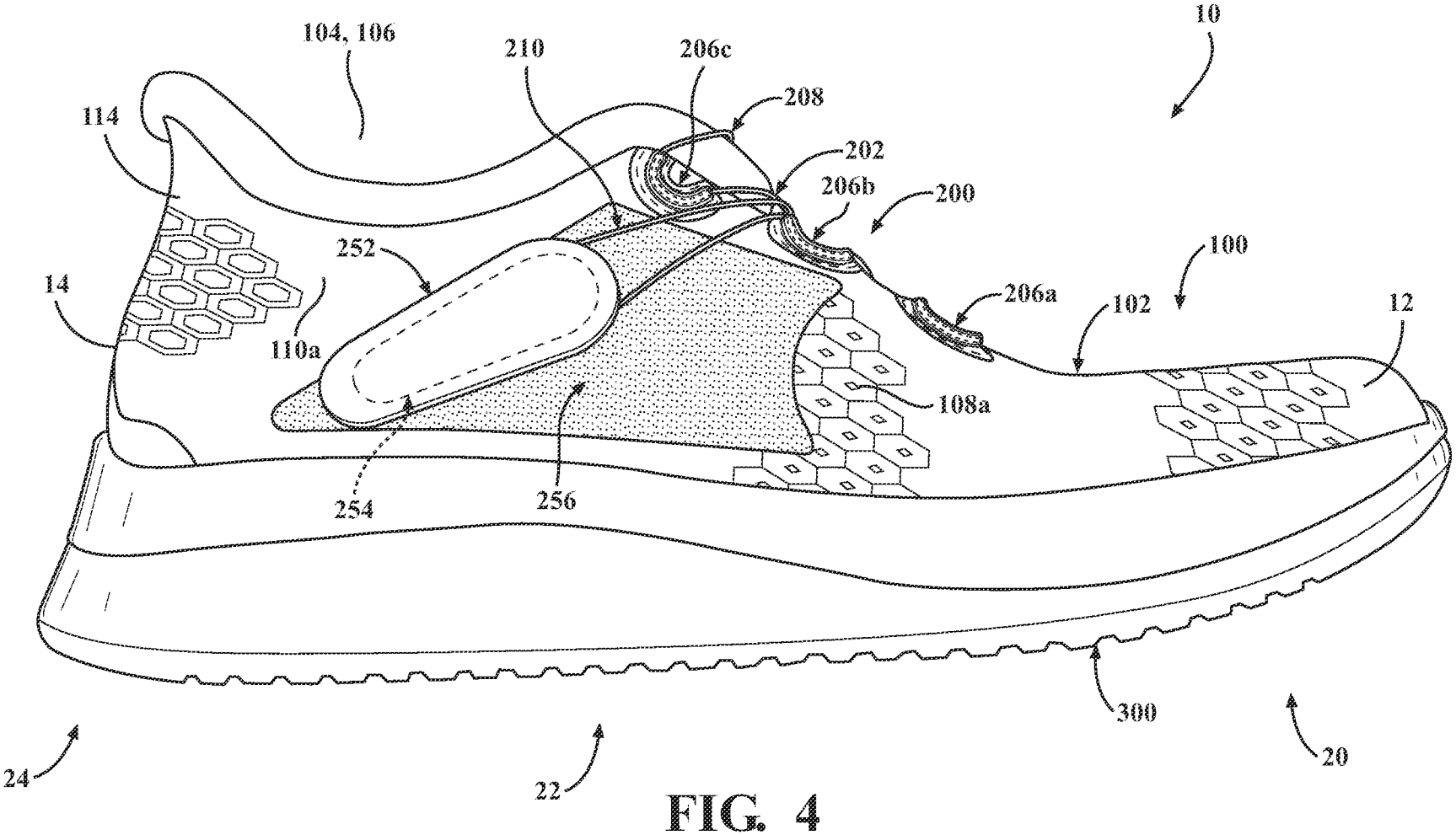
FIG. 4 is a lateral side elevation view of the article of footwear of FIG. 1.

With reference to FIGS. 1, 2, and 4, the control element 210 includes the first control segment 248*a* connected to the first tensioning segment 246*a* through the first routing element 214*a* of the tensioning guide 204, and the second control segment 248*b* connected to the second tensioning segment 246*b* through the second routing element 214*b* of the tensioning guide 204. As shown, the first control segment 248*a* extends from the first end 224*a* of the first routing element 214*a* of the tensioning guide 204 to a first free end 250*a* and the second control segment 248*b* extends from the second end 226*b* of the second routing element 214*b* to a second free end 250*b*.

In the illustrated example, each of the first free end 250*a* of the first control segment 248*a* and the second free end 250*b* of the second control segment 248*b* are attached to a tensioning grip 252. The tensioning grip 252 provides a unitary interface for simultaneously grasping the control segments 248*a*, 248*b* of the control element 210. As shown in FIGS. 1 and 2, the tensioning grip 252 may include first fastener 254 configured to interface with a second fastener 256 disposed on the enclosure 102. In the illustrated example, the first fastener 254 includes a hook-and-loop fabric formed on an inner surface of the tensioning grip 252 and the second fastener 256 includes a corresponding hook-and-loop fabric patch formed on the lateral side quarter panel 108*a* of the enclosure 102.

The combination of the tensioning grip 252 including the first fastener 254 and the oversized second fastener 256 disposed on the enclosure 102 allows the fit of the upper 100 to be easily adjusted with minimal manual dexterity. For instance, a user can easily grasp and pull the tensioning grip with a single hand. In use, the upper 100 is moved from a loosened state to a tightened state by applying the tightening force $F_T$ to the tensioning grip 252 of the control element 210. As provided above, the control segments 248*a*, 248*b* extend from the first end 224*a* of the first routing element 214*a* and the second end 226*b* of the second routing element 214*b*, which are oriented towards the lateral side 16 of the upper. Thus, applying the tightening force $F_T$ by pulling the tensioning grip 252 over the adjustment region 116 and towards the lateral side 16 of the upper 100 pulls each of the first strand 242 (i.e., the first tensioning segment 246*a* and first control segment 248*a*) and the second strand 244 (i.e., the second tensioning segment 246*b* and the second control segment 248*b*) through the routing elements 214*a*, 214*b* in the tightening direction $D_T$. As the cable 202 moves in the tensioning direction $D_T$, the effective length of the tensioning element 208 is shortened and the cable guides 204, 206*a*-206*e* on opposite edges 118*a*, 118*b* are drawn towards one another.

Once a desired fit of the upper 100 around the foot is obtained, the first fastener 254 on the tensioning grip 252 is secured to the second fastener 256 on the enclosure 102 to maintain the tension. As shown in FIG. 2, the second fastener 256 substantially covers the lateral side quarter panel 108*a* such that a size of the second fastener 256 is larger than the size of the first fastener 254. Accordingly, the first fastener 254 may be attached in different locations of the second fastener 256 to adjust the fit of the upper 100. For example, attaching the first fastener 254 at a location closer to the heel region 24 and/or the sole structure 300 will provide a tighter fit (i.e., shorter effective length of the tensioning element 208) than attaching the first fastener 254 at a location closer to the forefoot region 20 and/or the throat 114.

The following Clauses provide an exemplary configuration for an upper and an article of footwear described above.

Clause 1. An upper for an article of footwear, the upper comprising an enclosure including an adjustment region, a cable traversing the adjustment region and operable to selectively move the adjustment region between a relaxed state and a constricted state when tightened, and a cable tensioning guide attached to the enclosure and including a first conduit extending between a first end and a second end and a second conduit extending between a third end and a fourth end, the first conduit and the second conduit slidably receiving different portions of the cable and being concentric with one another.

Clause 2. The upper of Clause 1, wherein at least one of the first conduit and the second conduit are elongate.

Clause 3. The upper of any of the preceding Clauses, wherein the first conduit includes a first concave surface facing the adjustment region and a first convex surface disposed on an opposite side of the first conduit that the first concave surface.

Clause 4. The upper of Clause 3, wherein the second conduit includes a second concave surface facing the adjustment region and a second convex surface disposed on an opposite side of the second conduit than the second concave surface.

Clause 5. The upper of Clause 4, wherein the second concave surface opposes the first convex surface.

Clause 6. The upper of any of the preceding Clauses, wherein cable tensioning guide includes a base surrounding the first conduit and the second conduit and operable to be attached to a surface of the enclosure.

Clause 7. The upper of Clause 6, wherein the first conduit and the second conduit extend from a first surface of the base and form an outer surface of the upper.

Clause 8. The upper of Clause 7, wherein the first conduit and the second conduit respectively include a first opening and a second opening at a second surface of the base, the second surface of the base being disposed on an opposite side of the base than the first surface.

Clause 9. The upper of Clause 8, wherein the first opening of the first conduit and the second opening of the second conduit cooperate with the outer surface of the upper to surround the cable within the first conduit between the first end and the second end and within the second conduit between the third end and the fourth end.

Clause 10. An article of footwear incorporating the upper of any of the preceding Clauses.

Clause 11. An upper for an article of footwear, the upper comprising an enclosure including an adjustment region, a cable traversing the adjustment region and operable to selectively move the adjustment region between a relaxed state and a constricted state when tightened, and a cable tensioning guide attached to the enclosure and including (i) a first conduit having a first concave surface facing the adjustment region and extending between a first end and a second end and (ii) a second conduit having a second concave surface facing the adjustment region and extending between a third end and a fourth end, the first conduit and the second conduit slidably receiving different portions of the cable.

Clause 12. The upper of Clause 11, wherein at least one of the first conduit and the second conduit are elongate.

Clause 13. The upper of any of the preceding Clauses, wherein the first conduit includes a first convex surface disposed on an opposite side of the first conduit that the first concave surface.

Clause 14. The upper of Clause 13, wherein the second conduit includes a second convex surface disposed on an opposite side of the second conduit than the second concave surface.

Clause 15. The upper of Clause 14, wherein the second concave surface opposes the first convex surface.

Clause 16. The upper of any of the preceding Clauses, wherein cable tensioning guide includes a base surrounding the first conduit and the second conduit and operable to be attached to a surface of the enclosure.

Clause 17. The upper of Clause 16, wherein the first conduit and the second conduit extend from a first surface of the base and form an outer surface of the upper.

Clause 18. The upper of Clause 17, wherein the first conduit and the second conduit respectively include a first opening and a second opening at a second surface of the base, the second surface of the base being disposed on an opposite side of the base than the first surface.

Clause 19. The upper of Clause 18, wherein the first opening of the first conduit and the second opening of the second conduit cooperate with the outer surface of the upper to surround the cable within the first conduit between the first end and the second end and within the second conduit between the third end and the fourth end.

Clause 20. An article of footwear incorporating the upper of any of the preceding Clauses.

Clause 21. An upper for an article of footwear, the upper comprising an enclosure including an adjustment region extending from a first edge to a second edge formed on an opposite side of the adjustment region from the first edge, a cable tensioning guide attached to the enclosure adjacent to the first edge of the adjustment region, the cable tensioning guide including a first routing element extending from a first end facing the adjustment region to a second end facing the adjustment region and a second routing element extending from a third end facing the adjustment region to a fourth end facing the adjustment region, and a cable. The cable including a tensioning element having a first tensioning segment extending across the adjustment region from the second end of the first routing element and a second tensioning segment extending across the adjustment region from the first end of the second routing element and a control element having a first control segment connected to the first tensioning segment at the first routing element and extending from the first end of the first routing element and a second control segment connected to the second tensioning segment at the second routing element and extending from the second end of the first routing element.

Clause 22. The upper of Clause 21, wherein the first tensioning segment is connected to the second edge of the adjustment region at a first location and the second tensioning segment is connected to the second edge of the adjustment region at a second location.

Clause 23. The upper of any of the preceding Clauses, wherein the control element includes a tensioning grip connected to each of the first control segment and the second control segment.

Clause 24. The upper of Clause 23, wherein the enclosure includes a first fastening element disposed on an opposite side of the adjustment region than the cable tensioning guide, the first fastening element operable to selectively secure the tensioning grip to the enclosure.

Clause 25. The upper of any of the preceding Clauses, wherein each of the first routing element and the second routing element includes a bearing sleeve configured to slidingly receive the cable.

Clause 26. The upper of any of the preceding Clauses, wherein the first routing element and the second routing element are parallel to each other.

Clause 27. The upper of any of the preceding Clauses, further comprising a plurality of cable routing guides disposed adjacent to at least one of the first edge and the second edge, each of the cable routing guides including a single routing element extending from a first end facing the adjustment region to a second end facing the adjustment region and slidingly receiving a portion of the tensioning element therein.

Clause 28. The upper of Clause 27, wherein the plurality of cable routing guides include a first cable routing guide slidingly receiving the first tensioning segment at a first end of the second edge and a second cable routing guide slidingly receiving the second tensioning segment at a second end of the second edge.

Clause 29. The upper of Clause 28, further comprising a third cable routing guide slidingly receiving the first tensioning segment at the first end of the first edge and a fourth cable routing guide slidingly receiving the second tensioning segment at the second end of the first edge.

Clause 30. The upper of Clause 29, wherein the cable tensioning guide is disposed between the third cable routing guide and the fourth cable routing guide.

Clause 31. An upper for an article of footwear, the upper comprising an enclosure including an adjustment region extending from a first edge to a second edge formed on an opposite side of the adjustment region from the first edge, a cable tensioning guide attached to the enclosure adjacent to the first edge of the adjustment region and including a first conduit and a second conduit, and a cable. The cable including a tensioning element having a first tensioning segment extending across the adjustment region from the first conduit and a second tensioning segment extending across the adjustment region from the second conduit and a control element having a first control segment connected to the first tensioning segment at the first conduit and extending from the first conduit, and a second control segment connected to the second tensioning segment at the second conduit and extending from the second conduit.

Clause 32. The upper of Clause 31, wherein the first tensioning segment is connected to the second edge of the adjustment region at a first location and the second tensioning segment is connected to the second edge of the adjustment region at a second location.

Clause 33. The upper of any of the preceding Clauses, wherein the control element includes a tensioning grip connected to each of the first control segment and the second control segment.

Clause 34. The upper of Clause 33, wherein the enclosure includes a first fastening element disposed on an opposite side of the adjustment region than the cable tensioning guide, the first fastening element operable to selectively secure the tensioning grip to the enclosure.

Clause 35. The upper of any of the preceding Clauses, wherein each of the first conduit and the second conduit is defined by a bearing sleeve configured to slidingly receive the cable.

Clause 36. The upper of any of the preceding Clauses, wherein the first conduit and the second conduit are arcuate and parallel to each other.

Clause 37. The upper of any of the preceding Clauses, further comprising a plurality of cable routing guides disposed adjacent to at least one of the first edge and the second edge, each of the cable routing guides including a single conduit slidingly receiving a portion of the tensioning element therein.

Clause 38. The upper of Clause 37, wherein the plurality of cable routing guides include a first cable routing guide slidingly receiving the first tensioning segment at a first end of the second edge and a second cable routing guide slidingly receiving the second tensioning segment at a second end of the second edge.

Clause 39. The upper of Clause 38, further comprising a third cable routing guide slidingly receiving the first tensioning segment at the first end of the first edge and a fourth cable routing guide slidingly receiving the second tensioning segment at the second end of the first edge.

Clause 40. The upper of Clause 39, wherein the cable tensioning guide is disposed between the third cable routing guide and the fourth cable routing guide.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described.

The same may also be varied in many ways. Such variations are not to be regarded as a departure from the disclosure, and all such modifications are intended to be included within the scope of the disclosure.

What is claimed is:

1. An upper for an article of footwear, the upper comprising:

an enclosure including an adjustment region;

a cable traversing the adjustment region and operable to selectively move the adjustment region between a relaxed state and a constricted state when tightened;

a cable tensioning guide attached to the enclosure and including a first conduit extending between a first end and a second end and a second conduit extending between a third end adjacent to the first end and a fourth end adjacent to the second end, the first conduit and the second conduit slidably receiving different portions of the cable and being concentric with one another; and a tensioning grip connected to a first portion of the cable extending from the first end of the first conduit and connected to a second portion of the cable extending from the fourth end of the second conduit.

2. The upper of claim 1, wherein at least one of the first conduit and the second conduit are elongate.

3. The upper of claim 1, wherein the first conduit includes a first concave surface facing the adjustment region and a first convex surface disposed on an opposite side of the first conduit than the first concave surface.

4. The upper of claim 3, wherein the second conduit includes a second concave surface facing the adjustment region and a second convex surface disposed on an opposite side of the second conduit than the second concave surface.

5. The upper of claim 4, wherein the second concave surface opposes the first convex surface.

6. The upper of claim 1, wherein the cable tensioning guide includes a base surrounding the first conduit and the second conduit and operable to be attached to a surface of the enclosure.

7. The upper of claim 6, wherein the first conduit and the second conduit extend from a first surface of the base and form an outer surface of the upper.

8. The upper of claim 7, wherein the first conduit and the second conduit respectively include a first opening and a second opening at a second surface of the base, the second surface of the base being disposed on an opposite side of the base than the first surface.

9. The upper of claim 8, wherein the first opening of the first conduit and the second opening of the second conduit cooperate with the outer surface of the upper to surround the cable within the first conduit between the first end and the second end and within the second conduit between the third end and the fourth end.

10. An article of footwear incorporating the upper of claim 1.

11. An upper for an article of footwear, the upper comprising:

an enclosure including an adjustment region;

a cable traversing the adjustment region and operable to selectively move the adjustment region between a relaxed state and a constricted state when tightened;

a cable tensioning guide attached to the enclosure and including (i) a first conduit having a first concave surface facing the adjustment region and extending between a first end and a second end and (ii) a second conduit having a second concave surface facing the adjustment region and extending between a third end adjacent to the first end and a fourth end adjacent to the second end, the first conduit and the second conduit slidably receiving different portions of the cable; and a tensioning grip connected to a first portion of the cable extending from the first end of the first conduit and connected to a second portion of the cable extending from the fourth end of the second conduit.

12. The upper of claim 11, wherein at least one of the first conduit and the second conduit are elongate.

13. The upper of claim 11, wherein the first conduit includes a first convex surface disposed on an opposite side of the first conduit than the first concave surface.

14. The upper of claim 13, wherein the second conduit includes a second convex surface disposed on an opposite side of the second conduit than the second concave surface.

15. The upper of claim 14, wherein the second concave surface opposes the first convex surface.

16. The upper of claim 11, wherein the cable tensioning guide includes a base surrounding the first conduit and the second conduit and operable to be attached to a surface of the enclosure.

17. The upper of claim 16, wherein the first conduit and the second conduit extend from a first surface of the base and form an outer surface of the upper.

18. The upper of claim 17, wherein the first conduit and the second conduit respectively include a first opening and a second opening at a second surface of the base, the second surface of the base being disposed on an opposite side of the base than the first surface.

19. The upper of claim 18, wherein the first opening of the first conduit and the second opening of the second conduit cooperate with the outer surface of the upper to surround the cable within the first conduit between the first end and the second end and within the second conduit between the third end and the fourth end.

20. An article of footwear incorporating the upper of claim 11.

* * * * *